US010277978B2

(12) United States Patent
Yeh

(10) Patent No.: US 10,277,978 B2
(45) Date of Patent: Apr. 30, 2019

(54) SPEAKER DEVICE

(71) Applicant: COMPAL ELECTRONICS, INC., Taipei (TW)

(72) Inventor: Ru-Yen Yeh, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 15/784,449

(22) Filed: Oct. 16, 2017

(65) Prior Publication Data

US 2018/0324520 A1 Nov. 8, 2018

(30) Foreign Application Priority Data

May 2, 2017 (TW) ..... 106114557 A

(51) Int. Cl.
*H04R 1/28* (2006.01)

(52) U.S. Cl.
CPC ..... *H04R 1/2815* (2013.01)

(58) Field of Classification Search
CPC ..... H04M 2201/40; H04R 2400/01; H04R 2499/11
USPC ..... 381/110, 58, 59, 349, 351, 339, 345; 379/88.01, 88.02, 88.04; 704/275, 270.1, 704/246
See application file for complete search history.

(56) References Cited

U.S. PATENT DOCUMENTS 8,175,304 B1 * 5/2012 North ..... H04R 1/403 381/17
9,304,736 B1 * 4/2016 Whiteley ..... G06Q 20/40145
2015/0139464 A1 * 5/2015 Guo ..... H04R 1/02 381/334

FOREIGN PATENT DOCUMENTS

CN 2872775 Y 2/2007
CN 202652500 U 1/2013

* cited by examiner

*Primary Examiner* — Norman Yu
(74) *Attorney, Agent, or Firm* — Kirton McConkie; Evan R. Witt

(57) ABSTRACT

The speaker device includes a cylindrical main body, a sound receiving portion, plural speaker units and at least one passive radiation plate. The cylindrical main body includes a top portion and a bottom portion. The sound receiving portion disposed on the top portion of the cylindrical main body. The speaker units are disposed within the cylindrical main body. The exports of the speaker units face the directions extending radially outward from an axial center of the cylindrical main body respectively. Each of the speaker units outputs a voice signal. The passive radiation plate is disposed on a surrounding surface of the cylindrical main body, and located between the speaker units and the bottom portion of the cylindrical main body. The passive radiation plate is driven to produce resonance with the air within the cylindrical main body, which is vibrated by the vibration of the voice signal.

9 Claims, 4 Drawing Sheets

2

2

SPEAKER DEVICE

CROSS-REFERENCE TO RELATED APPLICATION

This application claims priority to Taiwan Patent Application No. 106114557 filed on May 2, 2017, the entire contents of which are incorporated herein by reference for all purposes.

FIELD OF THE DISCLOSURE

The present disclosure relates to a speaker device, and more particularly to a speaker device capable of expanding voice by a passive radiation plate without a guiding cone, a cylinder and a bass guiding tube.

BACKGROUND OF THE DISCLOSURE

With increasing development of digitization, a variety of electronic devices are gradually innovated to provide more functions. The requirement of a speaker device is gradually increased. For example, a voice assistant device is developed because operation of electrical product is not satisfied with operating interface of manual control, and user is communicated with electrical product by voice. Since the speaker device receives the voice of user to recognize and produces notice voice to notice user, the speaker device which can receive voice source is important to the voice assistant device.

FIGS. 1A and 1B are schematic perspective view and cross-sectional view illustrating a conventional speaker device respectively. As shown in FIGS. 1A and 1B, the conventional speaker device 1 which is applied to the voice assistant device comprises a cylindrical main body 10, a speaker unit 11, a guiding cone 12, plural cylinders 13, a bass guiding tube 14 and a sound receiving portion 15. The cylindrical main body 10 includes an upper housing and a lower housing assembled together. The speaker unit 11 is disposed within the cavity of the cylindrical main body 10. The sound export of the speaker unit 11 is oriented to the bottom portion 203 of the cylindrical main body 10. The guiding cone 12 is disposed under the speaker unit 11. The guiding cone 12 expands the voice signal of the speaker unit 11 to enhance the sound field of the speaker device 1. Since the distance between the speaker unit 11 and the guiding cone 12 is used to transmitting voice, the cylinders 13 are disposed between the speaker unit 11 and the guiding cone 12 for connecting and supporting the speaker unit 11. Consequently, the distance between the speaker unit 11 and the guiding cone 12 is maintained by the cylinders 13. The sound receiving portion 15 is disposed on the cylindrical main body 10. The sound receiving portion 15 receives an outer voice signal, for example, the voice produced by user. The bass guiding tube 14 is disposed within the cylindrical main body 10 and is located between the speaker unit 11 and the sound receiving portion 15. The bass guiding tube 14 is designed to enhance the low-frequency portion of the voice signal of the speaker unit 11.

Although the speaker device 1 employs the guiding cone 12 for enhancing the sound field of the speaker device 1, the speaker device 1 needs to dispose the cylinders 13 for supporting the speaker unit 11. Under this circumstance, portion of the voice signal emitted from the speaker unit 11 is reflected by the cylinders 13 so that the voice signal outputted from the speaker device 1 is decayed because of the size of the cylinders 13 and the numbers of the cylinders 13. Consequently, the sound field of the speaker device 1 is decreased. Moreover, since the bass guiding tube 14 of the speaker device 1 is adjacent to the sound receiving portion 15, the enhanced low-frequency signal of the bass guiding tube 14 is easily received by the sound receiving portion 15. Under this circumstance, the sound receiving portion 15 receives not only the outer voice signal but also the enhanced low-frequency signal of the bass guiding tube 14. The efficacy of the sound receiving portion 15 is bad because the sound receiving portion 15 receives two different voice sources. Furthermore, the speaker device 1 is assembled by the upper housing and the lower housing. The sound receiving portion 15, the bass guiding tube 14, the cylinders 13, the speaker unit 11 and the guiding cone 12 are discretely and asymmetrically disposed within the corresponding upper housing and lower housing. Hence, the speaker device 1 is probably not balanced and steady disposed on a setting surface because the weight of the upper side is not average with the weight of the lower side and the speaker device 1 is not symmetrical.

Therefore, there is a need of providing a speaker device in order to overcome the above drawbacks.

SUMMARY OF THE DISCLOSURE

The present disclosure provides a speaker device capable of expanding the voice by a passive radiation plate without a guiding cone, a cylinder and a bass guiding tube in order to enhance the efficacy of the acoustic field, enhance the efficacy of the sound receiving portion and balance easily.

In accordance with an aspect of the present disclosure, there is provided a speaker device. The speaker device includes a cylindrical main body, a sound receiving portion, plural speaker units and at least one passive radiation plate. The cylindrical main body includes a top portion and a bottom portion. The sound receiving portion is disposed on the top portion of the cylindrical main body. The speaker units are disposed within the cylindrical main body. The exports of the speaker units face the directions extending radially outward from an axial center of the cylindrical main body respectively. Each of the speaker units outputs a voice signal for allowing the air within the cylindrical main body to be vibrated. The passive radiation plate is disposed on a surrounding surface of the cylindrical main body and located between the speaker units and the bottom portion of the cylindrical main body. The passive radiation plate is driven to produce resonance with the air within the cylindrical main body, which is vibrated by the vibration of the voice signal.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
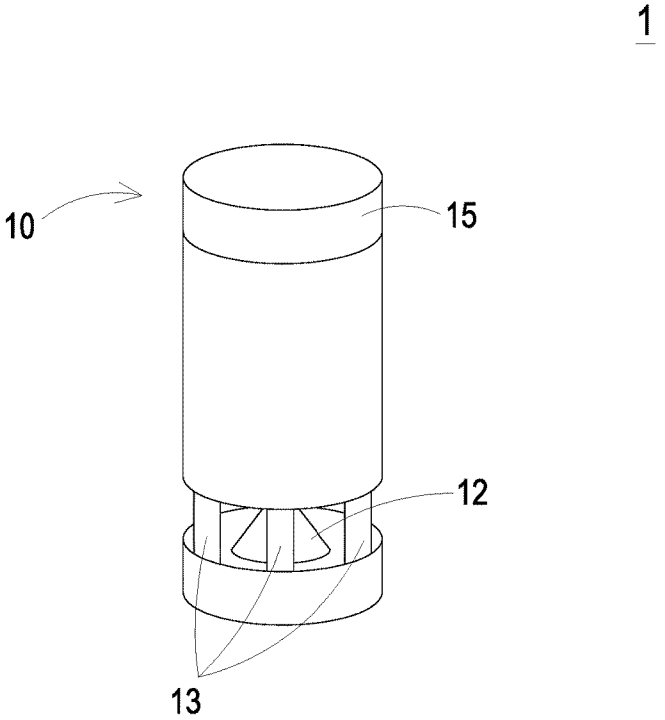
FIG. 1A (PRIOR ART)
FIGS. 1A and 1B are schematic perspective view and cross-sectional view illustrating a conventional speaker device respectively.
Figure 1B:
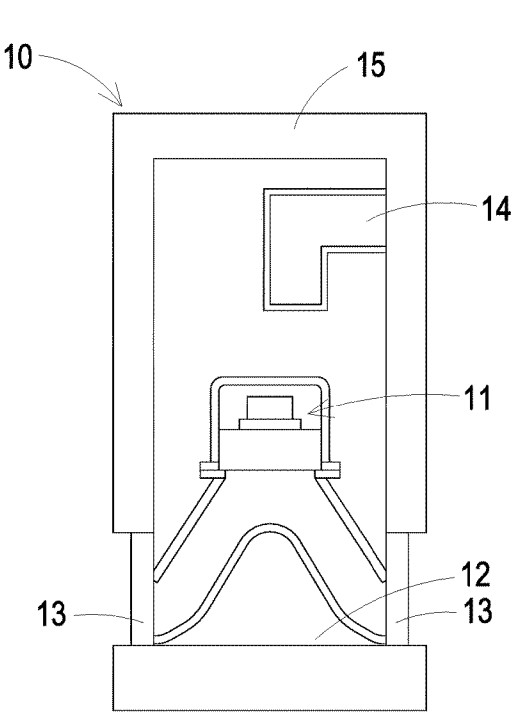
FIG. 1B (PRIOR ART)
Figure 2:
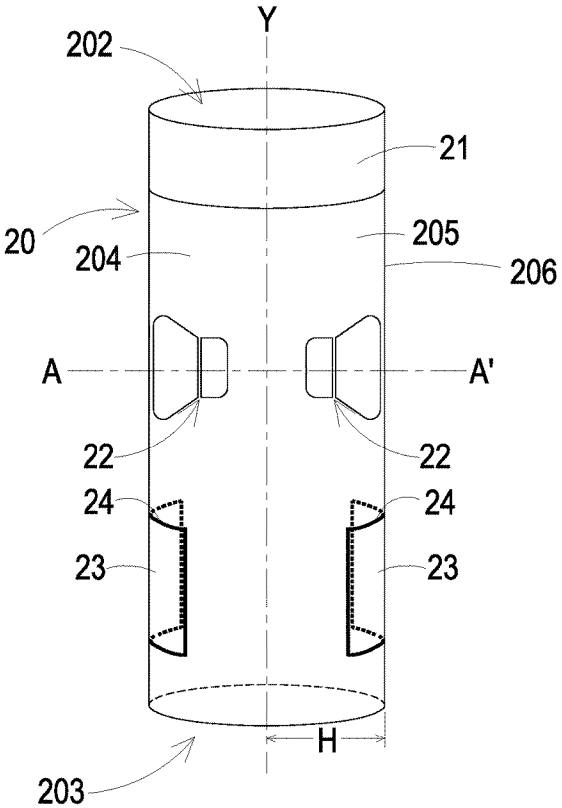
FIG. 2 is a schematic perspective view illustrating a portion of a speaker device according to an embodiment of the present disclosure.

FIG. 2 is a schematic perspective view illustrating a portion of a speaker device according to an embodiment of the present disclosure. As shown in FIG. 2, preferably but not exclusively, the speaker device 2 is applied to a voice assistant device. The speaker device 2 comprises a cylindrical main body 20, a sound receiving portion 21, plural speaker units 22 and at least one passive radiation plate 23. The structure of the cylindrical main body 20 is cylindrical. The cylindrical main body 20 comprises a top portion 202, a bottom portion 203 and a surrounding surface 206. The surrounding surface 206 connects the top portion 202 and the bottom portion 203, and the surrounding surface 206 is constituted by an outer surface of the cylindrical main body 20.

The sound receiving portion 21 is disposed on the top portion 202 of the cylindrical main body 20. The sound receiving portion 21 receives an outer voice signal, for example, voice produced by user. Preferably but not exclusively, the sound receiving portion 21 is a microphone. The speaker units 22 are accommodated and disposed within the cylindrical main body 20. The interior space of the cylindrical main body 20 is served as the cavity of the speaker units 22. Preferably but not exclusively, the speaker units 22 are radially arranged and symmetrically disposed with respect to an axial center Y of the cylindrical main body 20, and the speaker units 22 are disposed in the same plane and spaced apart with each other. The speaker units 22 are located between the sound receiving portion 21 and the passive radiation plate 23. The exports of the speaker units 22 face the directions extending radially outward from the axial center Y of the cylindrical main body 20. In the other words, the exports of the speaker units 22 face toward the exterior of the cylindrical main body 20 horizontally. Each of the speaker units 22 is configured to output a voice signal.

The passive radiation plate 23 is disposed on a surrounding surface 206 of the cylindrical main body 20. The passive radiation plate 23 is located between the speaker units 22 and the bottom portion 203 of the cylindrical main body 20. When the voice signal of the speaker units 22 is vibrated, the air within the interior space of the cylindrical main body 20 is vibrated by the vibration of the voice signal. Consequently, the passive radiation plate 23 is driven to produce resonance, and the acoustic field of the speaker device 2 can be expended by the passive radiation plate 23.

As mentioned above, the speaker device 2 expands the voice signal outputted from the speaker units 22 by the passive radiation plate 23. According to the conventional speaker device, it is necessary to dispose the guiding cone to enhance the acoustic field of the conventional speaker device and dispose the cylinders to support the speaker unit. The acoustic field of the conventional speaker device is hard to be enhanced due to the cylinders. Comparing with the conventional speaker device, the acoustic field of the speaker device 2 can be expanded excellently. Moreover, the sound receiving portion 21 of the speaker device 2 is disposed on the top portion 202 of the cylindrical main body 20. The speaker units 22 are located between the sound receiving portion 21 and the passive radiation plate 23. The passive radiation plate 23 of the speaker device 2 is located between the speaker units 22 and the bottom portion 203 of the cylindrical main body 20. Therefore, the passive radiation plate 23 actually keeps away from the sound receiving portion 21. According to the conventional speaker device, the efficacy of the conventional speaker device is poor because the export of the bass guiding tube of the conventional speaker device is nearby the sound receiving portion. Comparing with the conventional speaker device, the efficacy of the sound receiving portion 21 of the speaker device 2 is better.

In some embodiments, the cylindrical main body 20 further comprises at least one accommodation portion 24 corresponding to the passive radiation plate 23. The accommodation portion 24 of the cylindrical main body 20 is concavely formed on the surrounding surface 206 of the cylindrical main body 20. The accommodation portion 24 of the cylindrical main body 20 is located between the speaker units 22 and the bottom portion 203 of the cylindrical main body 20. The passive radiation plate 23 is accommodated within the accommodation portion 24 of the cylindrical main body 20. In addition, the horizontally distance H between the axial center Y of the cylindrical main body 20 and the surrounding surface 206 of the cylindrical main body 20 is ranged between 40 mm and 45 mm.

In some embodiments, the cylindrical main body 20 is assembled by a left housing 204 and a right housing 205. Preferably but not exclusively, the left housing 204 and the right housing 205 are semi-cylindrical housings. The left housing 204 and the right housing 205 are perpendicular to the axial center Y of the cylindrical main body 20. The left housing 204 and right housing 205 are radially arranged and symmetrically disposed with respect to the axial center Y of the cylindrical main body 20. In addition, the speaker device 2 comprises plural accommodation portions 24 and plural passive radiation plates 23. Preferably but not exclusively, the numbers of the accommodation portions 24 are two, and the numbers of the passive radiation plates 23 are two. The accommodation portions 24 are radially arranged and symmetrically disposed with respect to the axial center Y of the cylindrical main body 20. The passive radiation plates 23 are accommodated within the corresponding accommodation portions 24. In some embodiments, the speaker device 2 comprises two speaker units 22. The two speaker units 22 are disposed within the cylindrical main body 20. The two speaker units 22 are radially arranged and symmetrically disposed with respect to the axial center Y of the cylindrical main body 20. The two speaker units 22 are disposed in the same plane and spaced apart with each other. The angle difference between the two speaker units 22 on the surrounding surface 206 is 180 degrees. For example, when the angle of one of the speaker units 22 is 0 degrees on the surrounding surface 206, the angle of the other one of the speaker units 22 is 180 degrees on the surrounding surface 206.

As mentioned above, the accommodation portions 24, the passive radiation plates 23 and the speaker units 22 are radially arranged and symmetrically disposed with respect to the axial center Y of the cylindrical main body 20. The speaker device 2 is lateral symmetry. According to the conventional speaker device, the components are discretely and asymmetrically disposed within the conventional speaker device. Comparing with the conventional speaker device, the speaker device 2 is balanced and stable on a setting surface.

In some embodiments, the passive radiation plate 23 is a bass passive radiation plate. The bass passive radiation plate enhances the efficacy of a low-frequency signal of the voice signal.

Figure 3:
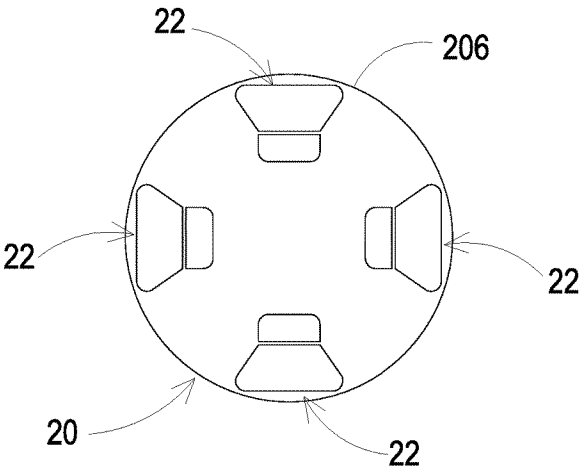
FIG. 3 is a schematic cross-sectional view illustrating the speaker device having four speaker units of FIG. 2 and taken along the line A-A'.

Certainly, the numbers of the speaker units 22 within the speaker device 2 is not limited to two. FIG. 3 is a schematic cross-sectional view illustrating the speaker device having four speaker units of FIG. 2 and taken along the line A-A'. As shown in FIG. 3, the speaker device 2 comprises four speaker units 22. The four speaker units 22 are radially arranged and symmetrically disposed with respect to the axial center Y of the cylindrical main body 20. The four speaker units 22 are disposed within the cylindrical main body 20. The four speaker units 22 are disposed in the same plane and spaced apart with each other. The angle difference between any two adjacent speaker units 22 on the surrounding surface 206 is 90 degrees. For example, when the angle of the one of the speaker units 22 is 0 degrees on the surrounding surface 206, the angle of the others of the speaker units 22 are 90 degrees, 180 degrees and 270 degrees on the surrounding surface 206 of the cylindrical main body 20, respectively. In addition, the voice signal of the speaker device 2 is increased by 3 dB when the numbers of the speaker units 22 is increased by one.

From the above descriptions, the present disclosure provides a speaker device. The speaker device comprises a cylindrical main body, a sound receiving portion, plural speaker units and at least one passive radiation plate. The speaker device expands the voice signal outputted from the speaker units by the passive radiation plate. The acoustic field of the speaker device can be expanded excellently. In addition, the sound receiving portion of the speaker device is disposed on the top portion of the cylindrical main body. The speaker units are located between the sound receiving portion and the passive radiation plate. The passive radiation plate of the speaker device is located between the speaker units and the bottom portion of the cylindrical main body. Therefore, the passive radiation plate actually keeps away from the sound receiving portion. The efficacy of the sound receiving portion of the speaker device is better. Moreover, the accommodation portions, the passive radiation plates and the speaker units are radially arranged and symmetrically disposed with respect to the axial center of the cylindrical main body. The speaker device is lateral symmetry. The speaker device is balanced and stable on a setting surface.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A speaker device, comprising:

a cylindrical main body comprising a top portion and a bottom portion;

a sound receiving portion disposed on the top portion of the cylindrical main body;

plural speaker units disposed within the cylindrical main body, wherein the exports of the speaker units face the directions extending radially outward from an axial center of the cylindrical main body respectively, and each of the speaker units outputs a voice signal for allowing the air within the cylindrical main body to be vibrated; and at least one passive radiation plate disposed on a surrounding surface of the cylindrical main body, and located between the speaker units and the bottom portion of the cylindrical main body, wherein the passive radiation plate is driven to produce resonance with the air within the cylindrical main body, which is vibrated by the vibration of the voice signal.

2. The speaker device according to claim 1, wherein the speaker device is applied to a voice assistant device.

3. The speaker device according to claim 1, wherein the speaker device further comprises at least one accommodation portion corresponding to the passive radiation plate, wherein the accommodation portion is concavely formed on the surrounding surface of the cylindrical main body, and the passive radiation plate is accommodated within the accommodation portion of the cylindrical main body.

4. The speaker device according to claim 3, wherein the speaker device comprises plural accommodation portions and plural passive radiation plates, wherein the accommodation portions are radially arranged and symmetrically disposed with respect to the axial center of the cylindrical main body.

5. The speaker device according to claim 1, wherein the passive radiation plate is a bass passive radiation plate.

6. The speaker device according to claim 1, wherein the numbers of the speaker units are two, and the two speaker units are radially arranged and symmetrically disposed with respect to the axial center of the cylindrical main body.

7. The speaker device according to claim 1, wherein the numbers of the speaker units are four, and the four speaker units are radially arranged and symmetrically disposed with respect to the axial center of the cylindrical main body.

8. The speaker device according to claim 1, wherein the cylindrical main body is assembled by a left housing and a right housing, wherein the left housing and right housing are perpendicular to the axial center of the cylindrical main body.

9. The speaker device according to claim 1, wherein the horizontally distance between the axial center of the cylindrical main body and the surrounding surface of the cylindrical main body is ranged between 40 mm and 45 mm.

* * * * *